US009968987B2

(12) United States Patent
Henke et al.

(10) Patent No.: US 9,968,987 B2
(45) Date of Patent: May 15, 2018

(54) ADJUSTMENT AID FOR A JOINING DEVICE HAVING A PUNCH AND A COUNTER-TOOL, AND METHOD FOR ADJUSTING THE JOINING DEVICE

(71) Applicant: BÖLLHOFF VERBINDUNGSTECHNIK GMBH, Bielefeld (DE)

(72) Inventors: Dennis Henke, Rheda-Wiedenbrück (DE); Mathias Heger, Oerlinghausen (DE); Andreas Jakobsche, Bielefeld (DE)

(73) Assignee: Böllhoff Verbindungstechnik GmbH, Bielefeld (DE)

( * ) Notice: Subject to any disclaimer, the term of this patent is extended or adjusted under 35 U.S.C. 154(b) by 277 days.

(21) Appl. No.: 14/895,357

(22) PCT Filed: May 15, 2014

(86) PCT No.: PCT/EP2014/060017

§ 371 (c)(1),
(2) Date: Dec. 2, 2015

(87) PCT Pub. No.: WO2014/195107

PCT Pub. Date: Dec. 11, 2014

(65) Prior Publication Data

US 2016/0107223 A1 Apr. 21, 2016

(30) Foreign Application Priority Data

Jun. 4, 2013 (DE) ..... 10 2013 210 370

(51) Int. Cl.
*B21J 15/02* (2006.01)
*B21K 23/00* (2006.01)
(Continued)

(52) U.S. Cl.
CPC ..... *B21J 15/02* (2013.01); *B21C 51/005* (2013.01); *B21J 15/025* (2013.01); *B21J 15/10* (2013.01);
(Continued)

(58) Field of Classification Search
CPC ..... Y10T 29/49758; Y10T 29/49764; Y10T 29/49778; Y10T 29/4978; Y10T 29/49833;
(Continued)

(56) References Cited

U.S. PATENT DOCUMENTS 2,898,688 A * 8/1959 Cottar ..... B25H 7/04 220/3.4
3,126,776 A * 3/1964 Whistler, Sr. et al. ..... B21D 37/142 29/407.1
(Continued)

FOREIGN PATENT DOCUMENTS

CN 101024238 A 8/2007
DE 2720126 A1 11/1977
(Continued)

OTHER PUBLICATIONS

CN Decision to Grant for CN Application No. 201480032322.2 dated Aug. 25, 2017, 4 pages.
(Continued)

*Primary Examiner* — Jason L Vaughan
(74) *Attorney, Agent, or Firm* — Reising Ethington P.C.; Matthew J. Schmidt

(57) ABSTRACT

The present disclosure provides an adjustment aid for a joining device having a punch and a counter-tool which can be oriented coaxially to one another and can be moved axially towards each other for a joining movement relative to one another. Furthermore, the present disclosure provides
(Continued)

Figures 1A, 1B, 1C, 1D, 1E:
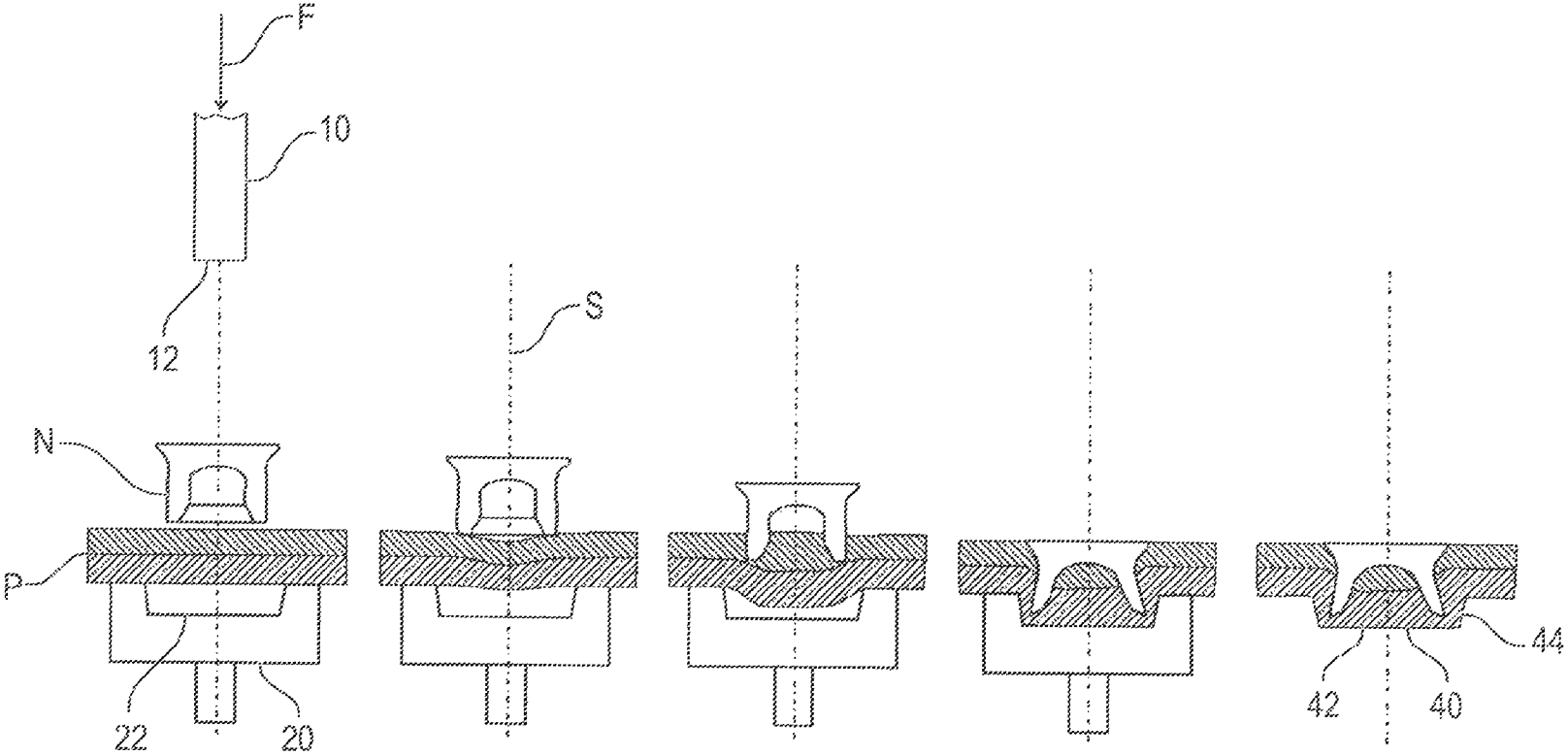

a method for adjusting a joining device with a punch and counter-tool. A grid marking is embossed in a reshaped test part with the assistance of an embossable grid marking on a punch surface or on a counter surface of the counter-tool. This grid marking is evaluable in comparison to the discernible impressions of the punch surface and counter surface of the counter-tool.

21 Claims, 8 Drawing Sheets

(51) Int. Cl.
*B21C 51/00* (2006.01)
*B21J 15/28* (2006.01)
*B21J 15/36* (2006.01)
*B21J 15/10* (2006.01)

(52) U.S. Cl.
CPC ..... *B21J 15/28* (2013.01); *B21J 15/36* (2013.01); *B21K 23/00* (2013.01)

(58) Field of Classification Search
CPC ..... Y10T 29/49835; Y10T 29/49837; Y10T 29/49938; Y10T 29/49945; Y10T 29/49954; Y10T 29/49956; Y10T 29/53022; Y10T 29/5377; Y10T 29/53774; Y10T 29/53961; Y10T 29/5397; Y10T 29/53978; Y10T 29/53991; Y10T 29/53996; B21J 15/025
USPC .... 29/243.53, 432.1, 509, 520, 465, 407.09, 29/407.1
See application file for complete search history.

(56) References Cited

U.S. PATENT DOCUMENTS 3,209,437 A * 10/1965 Voorhies ..... B21K 25/00 123/90.51
3,334,406 A * 8/1967 Bennett ..... B21D 28/34 29/407.09
3,387,481 A 6/1968 Harvey et al.
3,526,947 A * 9/1970 Pasek ..... B25H 7/04 29/701
4,007,537 A * 2/1977 Silverbush ..... A41H 37/04 198/394
4,103,413 A 8/1978 Malmberg et al.
4,130,922 A 12/1978 Koett
4,189,820 A * 2/1980 Slack ..... H05K 3/0002 29/407.09
4,209,103 A * 6/1980 Glovier ..... H02G 3/12 220/3.4
4,345,381 A * 8/1982 Brislin ..... E05B 17/06 156/240
4,555,838 A 12/1985 Muller
4,610,072 A * 9/1986 Muller ..... B23P 19/062 227/120
4,763,980 A * 8/1988 Gerber ..... G02B 6/3843 173/1
4,813,820 A * 3/1989 Cadwell ..... G01L 1/2287 408/1 R
4,969,273 A * 11/1990 Richards ..... A47G 1/205 33/197
5,050,288 A * 9/1991 Woods ..... B21J 15/10 29/407.1
5,148,591 A * 9/1992 Pryor ..... A01B 69/008 29/407.04
5,751,011 A * 5/1998 McLaughlin ..... D01D 4/02 250/559.29
6,146,072 A * 11/2000 Muller ..... B23P 19/062 411/176
6,199,271 B1 * 3/2001 Hahn ..... B21D 39/031 29/254
6,560,891 B1 * 5/2003 Arnold ..... B26D 7/015 33/564
6,722,013 B1 4/2004 Rapp
7,080,438 B2 * 7/2006 Murakami ..... B23K 20/1255 228/112.1
7,185,442 B2 * 3/2007 Grillo ..... A47G 1/205 33/613
7,240,711 B2 * 7/2007 Chan ..... H01L 21/67092 156/351
7,350,312 B1 * 4/2008 Grillo ..... A47G 1/205 33/613
7,363,720 B2 * 4/2008 DiGavero ..... B25H 7/02 33/528
9,283,612 B2 * 3/2016 Trojer ..... B21D 39/031
2002/0007544 A1 * 1/2002 Harada ..... B29C 31/00 29/407.1
2007/0084038 A1 4/2007 Cochet

FOREIGN PATENT DOCUMENTS

DE 19743277 A1 5/1999
DE 20102539 U1 11/2001
DE 102008024938 A1 11/2009
EP 1481745 A1 12/2004
GB 2459557 4/2009
GB 2459557 A 11/2009
IT 1209836 B 8/1989
JP H07217622 8/1995
JP 2003290865 10/2003
SE 427297 B 3/1983
WO WO9949227 A2 9/1999

OTHER PUBLICATIONS

Written Opinion & International Search Report for PCT/EP2014/060017 dated Oct. 28, 2014, 13 pages.
English translation of the International Preliminary Report on Patentability for PCT/EP2014/060017 dated Dec. 17, 2015, 13 pages.

* cited by examiner

ADJUSTMENT AID FOR A JOINING DEVICE HAVING A PUNCH AND A COUNTER-TOOL, AND METHOD FOR ADJUSTING THE JOINING DEVICE

1. TECHNICAL FIELD

The present disclosure relates to an adjustment aid for a joining device having a punch and a counter-tool which can be oriented coaxially to one another and can be moved axially towards each other for a joining movement relative to one another. Furthermore, the present disclosure relates to a method for adjusting such a joining device.

2. BACKGROUND

Joining devices with a punch and a counter-tool which can be oriented coaxially to one another and can be moved axially towards each other for a joining movement relative to one another are known and serve in particular to create connections. Such joining devices include tools for setting punch rivets and joining tools, for example to clinch metal sheets. With these known-devices, the punch provided with a drive and the counter-tool matching the punch must always be coaxially aligned with each other. Such a counter-tool forms, for example, a die such that, when setting a punch rivet, a closing head supporting the connection forms in the metal sheets to be connected with each other.

Significant demands are placed on the punch and counter-tool being coaxial since the strength of the connection to be established as well as the appearance of the connection are dependent thereupon. The coaxiality of the punch and counter-tool is just as important in presses, embossing machines and punches since the tools interacting with each other in this context must be aligned coaxially to each other. Consequently, the general term "joining device" is to be understood as all devices which work with tools that are coaxially aligned with each other and move toward each other, such as the above-described devices.

One object that may be achieved by at least some implementations of the present invention is to provide an adjustment aid for a joining device as well as a corresponding method to facilitate the coaxial alignment of the tool and counter-tool with reference to each other.

3. SUMMARY

The above object is solved by the adjustment aid in accordance with independent patent claims 1 and 13, and by a method for adjusting a joining device in accordance with independent patent claim 15. Advantageous embodiments and further developments of the present invention result from the description, the accompanying drawings and the appending claims.

The adjustment aid is configured for joining devices having a punch and a counter-tool which can be oriented coaxially to one another and can be moved axially towards each other for a joining movement relative to one another. The counter-tool of the adjusting aid comprises an at least partially flat counter surface which is arranged opposite of an at least partially flat punch surface of the punch, as well as an embossable grid marking which is provided on the counter surface and/or the punch surface, such that the grid marking is embossable on the test part shaped or reformed on the counter surface and/or the punch surface.

The adjustment aid is based on the principle of deforming a test part between the punch and counter-tool by their movement toward each other. Given the prerequisite that the punch and counter-tool have an at least partially flat counter surface and punch surface, the imprints in the counter-surface and punch-surface in the test part are discernible by means of this deforming process. After such a deformation of the test part has occurred, the impressions in the counter-surface and punch surface located in the top and bottom side of the deformed test part are comparable with each other. The comparison of the counter surface and punch surface provides information on the extent to which the punch and counter-tool are not coaxially aligned in reference to each other. As an orientation aid in the comparison of the impressions of the counter surface and punch surface, at least one of the two surfaces has an embossable grid marking. By using this embossed grid marking in the test part in comparison with at least one additional reference point, the extent to which the punch and/or the counter-tool deviate from a desired coaxiality is discernible.

According to a further embodiment, the adjustment aid is provided for a setting device. In this embodiment, the counter-tool is shaped as a die with a grid marking to form a closing head. Preferably, the die possesses a pot-shaped design in which the embossable grid marking is arranged on its base. If a test part is deformed in the pot-shaped die so that a closing head is formed, this grid marking is embossed in one side of the closing head. If the arrangement, or respectively the impression of the grid marking, is compared with an edge area of the closing head, inferences can be drawn with respect to the arrangement of the punch and counter-tool with reference to each other.

According to another embodiment, any die can be used as an adjustment aid. To generate a flat counter surface in the die, an insertion plate is placed in the die. On its flat counter-surface facing the punch, this insertion plate has the embossable grid marking. It is also preferable for the insertion plate to have a shape on its side facing away from the punch which is shaped complementary to the die base. Based on this embodiment, the insertion plate optimally matches the base of an existing die and generates a flat counter surface with a grid marking facing the punch. If a test part is deformed between the punch and die with an insertion plate, a closing head forms in the test part with an embossed grid marking. In this context, it is also preferable to provide the flat counter surface with the grid marking directly in the die so that an additional insertion plate is unnecessary.

According to different embodiments of the adjustment aid, the closing head is produced by the punch in combination with a punch rivet or with a test body, wherein in these cases, the punch rivet or test body forms the punch surface. Although a potentially different shape of the closing head may arise when a punch rivet or test body is used, both results of shaping can equally be interpreted as an adjustment aid for evaluating the coaxiality of the punch and counter tool. Whereas the punch rivet in the die set by the punch generates a closing head whose shape can be interpreted in combination with the embossed grid marking, a similar closing head which can be interpreted in the same manner can also be generated with the test body. Whereas the test body also shapes the test part in the die and thereby generates a closing head with an embossed grid marking, it is furthermore preferable to provide an additional grid marking on the side of the test body facing the test part. After a closing head is produced in this manner, the embossed grid marking in the top and bottom side, or respectively in the opposing sides of the test part, can be evaluated in order to draw inferences with respect to the coaxiality of the punch and counter-tool.

According to another embodiment of the adjustment aid, the counter-tool is a test die which has a free-standing projection which projects toward the punch and has the flat counter surface with the grid marking, as well as a clearance surrounding the projection.

With the assistance of the test die, it is possible to shape or to reform the test part on the projection projecting in that direction. With the assistance of this design arrangement, a closing head does not arise in the test part. Instead, a closing ring is formed on the side of the test part facing the test die which surrounds the embossed grid marking. To this end, the flat counter surface with the grid marking preferably forms the side of the projection facing the punch. It is furthermore preferable for the projection to have the same outer diameter as the punch surface of the punch or a test body which forms the punch surface. Since the test part is deformed between the punch or test body and the projecting projection of the test die, a closing ring forms on each of the opposing sides of the test part. If the position of the two opposing rings with reference to each other is evaluated, inferences can be drawn therefrom with respect to the coaxial adjustment of the punch and counter-tool with reference to each other.

According to another embodiment of the adjustment aid with the test die, the joining device comprises a retainer by means of which the test part is compressible, or respectively shapeable, when a radial clearance is left around to the punch or test body. It is likewise also preferable for the test die to have a ring-like construction which radially surrounds the projection at a distance and is arranged opposite the retainer.

With the assistance of the preferred constructions consisting of the retainer and ring-like construction of the test die, it is possible to sufficiently hold or retain the test part so that the evaluable closing rings as well as the embossable grid marking are formed in the test part without being influenced. This ensures that the evaluable deformation of the test part is not distorted by changes in the test part arrangement.

As has already been briefly addressed above, in another embodiment, the punch surface of the punch, or the test body which forms the punch surface, is equipped with a second embossable grid marking such that two opposing grid markings arranged opposite each other are embossable in the test part during the joining movement. With the assistance of these grid markings that oppose each other, the evaluation is assisted as to whether the punch and the counter-tool are aligned coaxially with each other. Since the grid markings preferably contain orientation markers how they are aligned with reference to the punch, these embossed grid markings can be easily interpreted and contextualized even though they are arranged on different sides of the test part.

Whereas the interpretation can be made by the worker based on the visual appearance, it is also preferable to record the embossed grid markings on the test part which oppose each other by using two cameras. Since the imaging axes of these two cameras are preferably aligned coaxially with each other, the image data recorded digitally or in analogue can be superimposed on each other in a known manner in order to draw inferences about the desired coaxiality of the punch and counter-tool.

As an additional orientation aid, it is preferable to provide a through-hole in the test part. The orientation of the closing rings which have been embossed on the test part by the punch and counter tool already provide inferences with respect to the through-hole as to whether the punch and counter-tool are adjusted coaxially with each other. If in addition grid markings are preferably inserted on the punch surface and/or the counter-tool, these, in combination with the through-hole as an orientation aid, permit an even more detailed evaluation of the reshaping of the test part, and hence the desired coaxiality of the punch and counter-tool.

The present disclosure furthermore describes an adjustment aid for a joining device with a punch and a counter-tool which can be oriented coaxially to one another and can be moved axially towards each other for a joining movement relative to one another in which the counter-tool has a die with a free-standing projection projecting toward the punch that comprises an at least partially flat counter surface which is arranged opposite an at least partially flat punch surface of the punch such that two evaluable closing rings arranged opposite each other can be generated in a body by the punch surface and counter surface during the joining movement. It is therefore preferable for the adjustment aid herein described to correspond to the above-described combination of the punch and test die, with the exception that in this case, the embossable grid marking is not used on the counter surface or the punch surface. Merely embossing one closing ring on each of the opposing sides of the test part is sufficient to determine the position of the punch and counter-tool with reference to each other, and accordingly determine their coaxiality with reference to each other.

According to a embodiment of the described adjustment aid, the counter surface and/or the punch surface have a grid marking by means of which a misalignment between the punch and counter-tool can be additionally determined.

Furthermore, also disclosed is a method for adjusting a joining device having a punch and a counter-tool which can be oriented coaxially to one another and can be moved axially towards each other for a joining movement relative to one another. The method comprises the following steps: Performing a joining movement with the punch relative to the counter-tool such that an at least partially flat counter surface of the counter tool, and an at least partially flat punch surface of the punch, are embossed in the test part, evaluating the counter-surface and punch-surface embossed in the test part, and changing the arrangement of the punch and counter-tool relative to each other to achieve a coaxial alignment of the punch and counter-tool. According to a further embodiment, the above-described method is repeated in a plurality of iteration steps to thereby approximate or adjust an optimum arrangement of the punch and die. Preferably, the method is only used with a punch and counter-tool without the grid marking so that the closing rings created in the test part provide information on the coaxial alignment of the punch and counter-tool during the evaluation.

According to another embodiment of the method, the counter-tool is formed by the already discussed die having a flat die surface with an embossable grid marking. If a closing head is created within the die and the grid marking is embossed in the closing head, the embossed grid marking can be evaluated in comparison with the edge area of the closing head. It is furthermore preferable to create the above-addressed closing rings with the assistance of a die as the counter-tool which has a free-standing projection projecting toward the punch. Since the punch and projection are arranged in a free-standing manner, the material of the test part deforms into a closing ring which forms a bulge of material on each of the opposing sides of the test part.

In order to be able to evaluate the deformations achieved in the test part, it is furthermore preferable for the two opposing sides of the test part to be imaged by two cameras whose imaging axes are coaxially aligned with each other, and then evaluate the two imaged sides of the test part, preferably by superimposing the two images. This is feasible with image data recorded both digitally as well as in analogue. The extent to which the punch and die deviate from an optimum alignment relative to each other, in particular a coaxial alignment, is preferably determined during the evaluation. This includes, alternately or in combination, a) checking the axial orientation of the punch and die, and/or b) detecting a radial shift of the punch surface and/or the counter surface, and/or c) measuring or calculating the direction and/or the absolute extent or magnitude of the radial shift.

4. DETAILED DESCRIPTION OF THE DRAWINGS

Figures 2A, 2B, 2C, 2D, 2E:
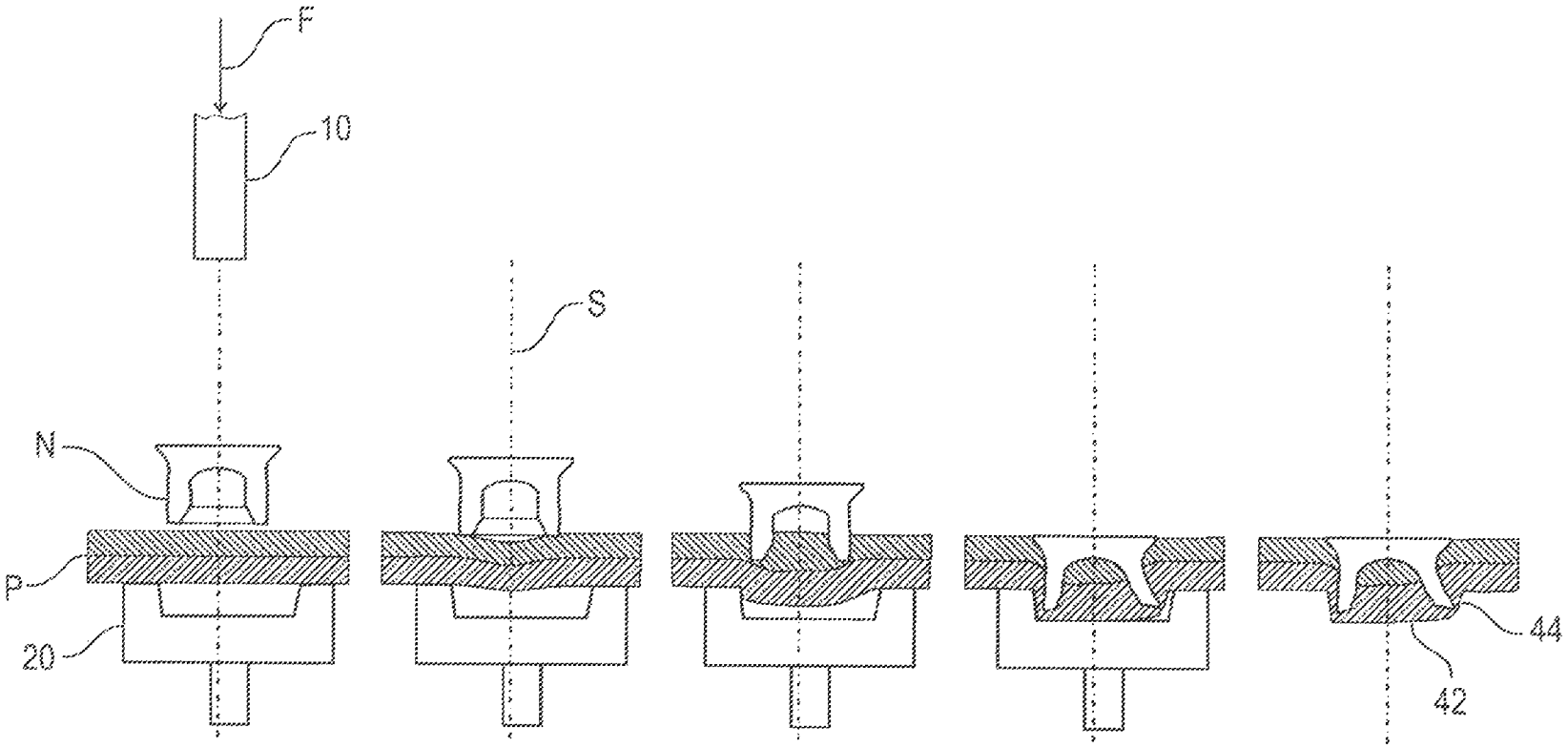
Figure 3:
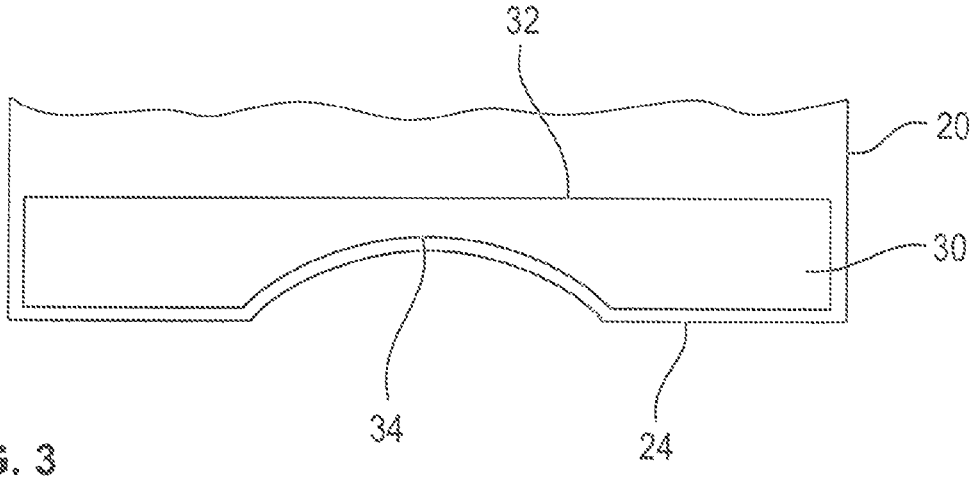
Figure 4:
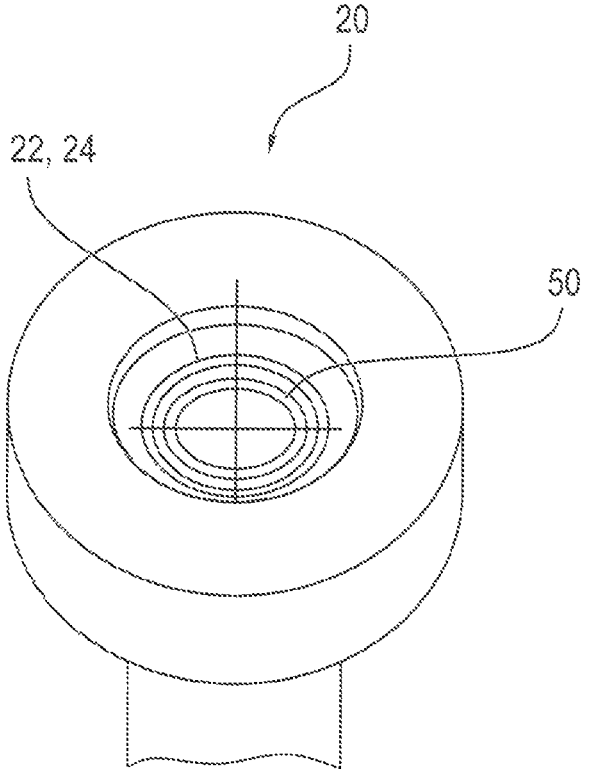
Figure 5:
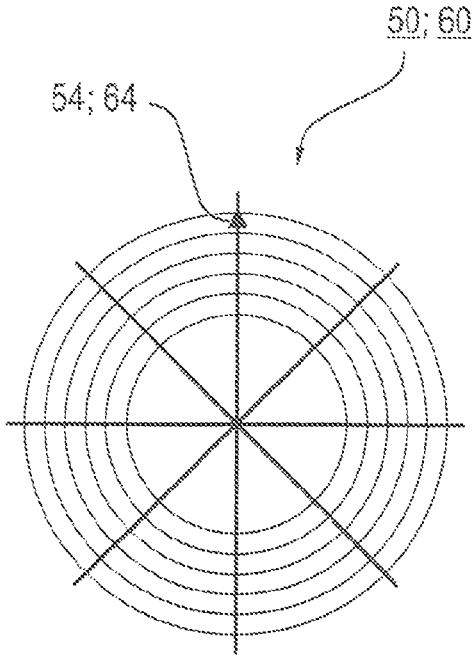
Figure 6:
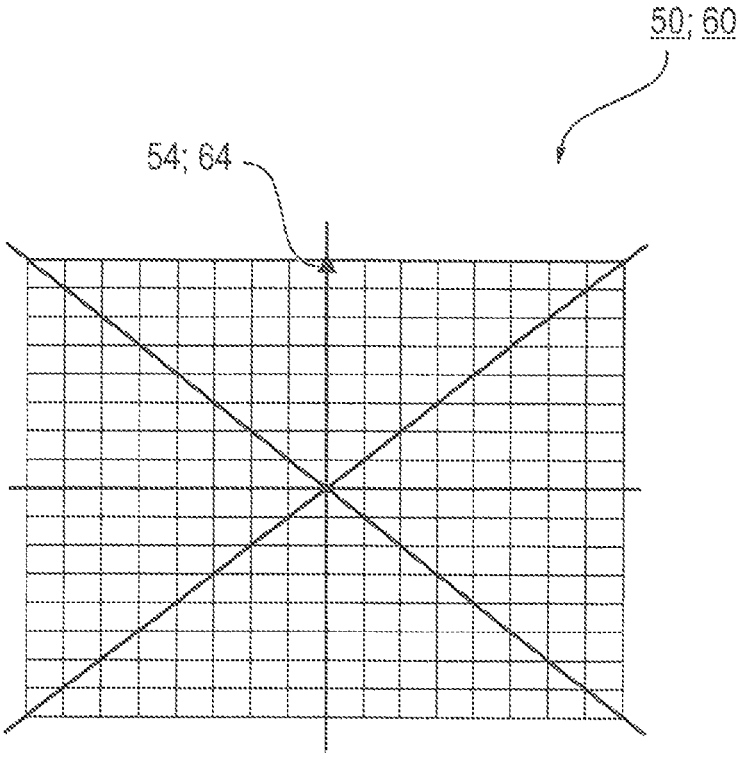
Figure 7:
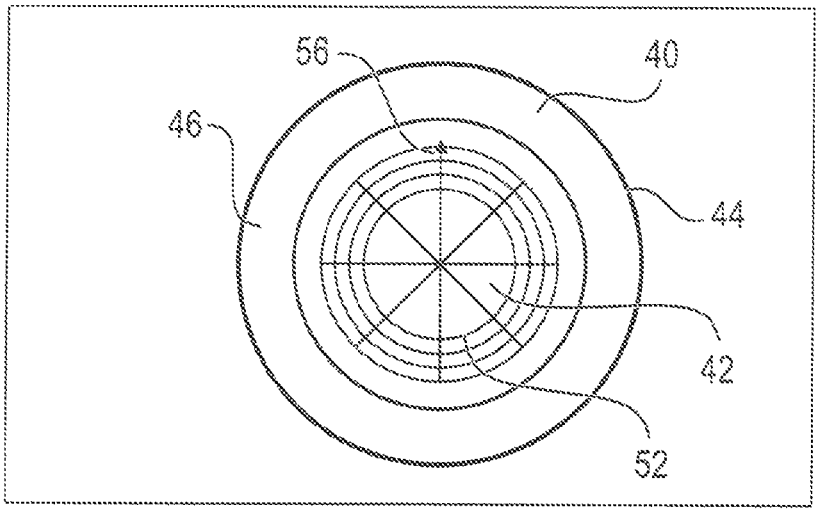
Figure 8:
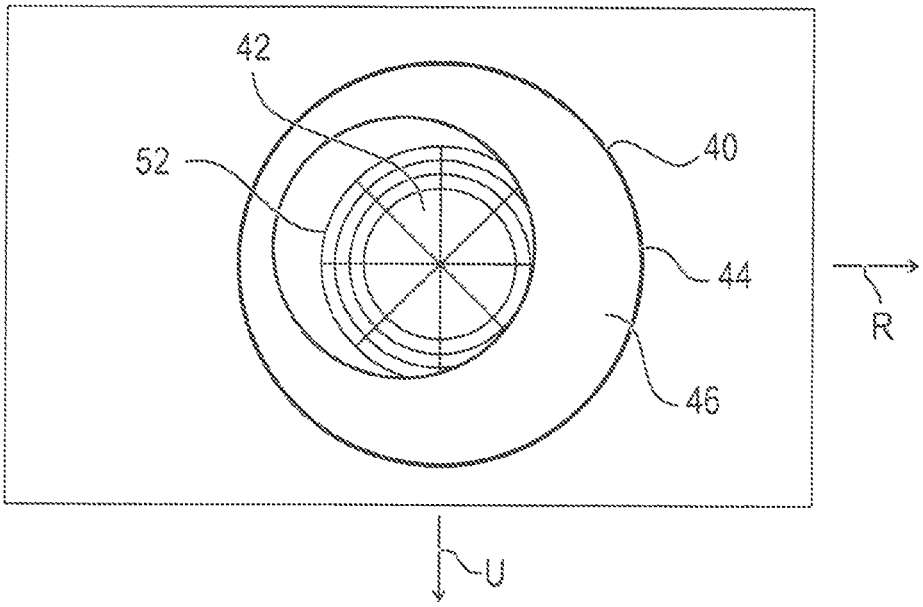
Figure 9:
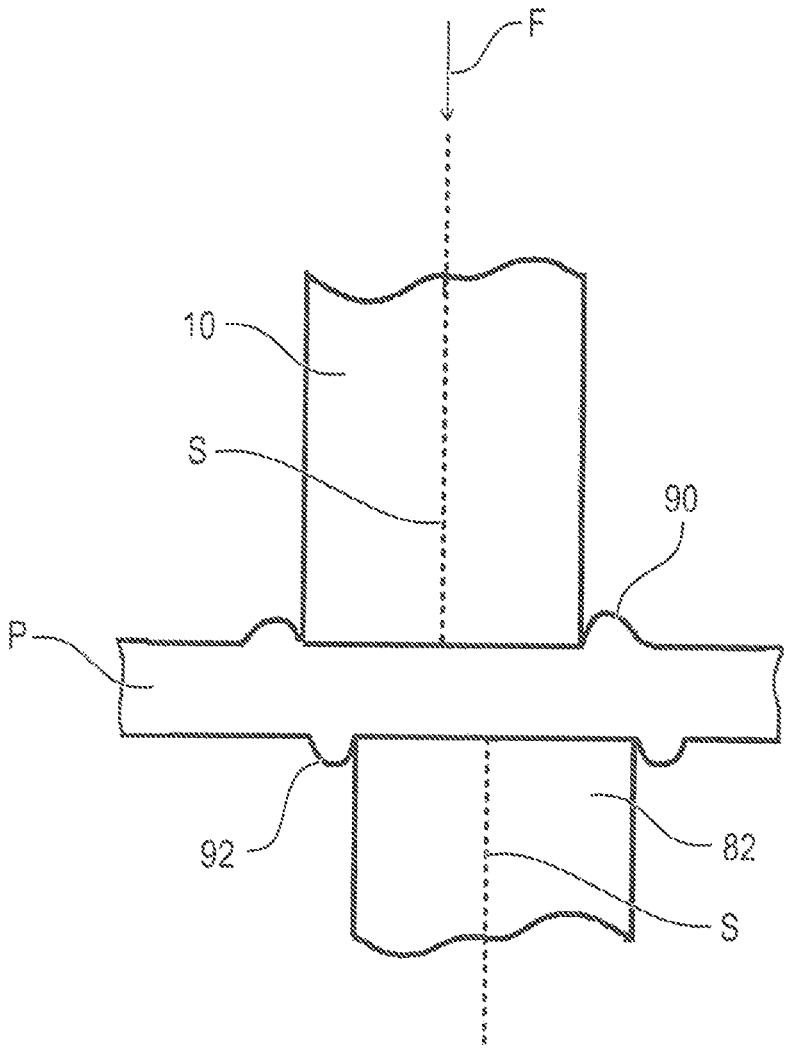
Figure 10A:
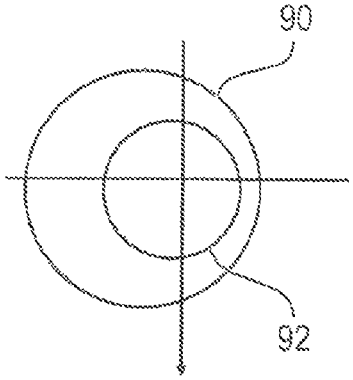
Figure 10B:
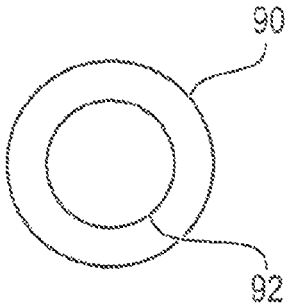
Figure 11:
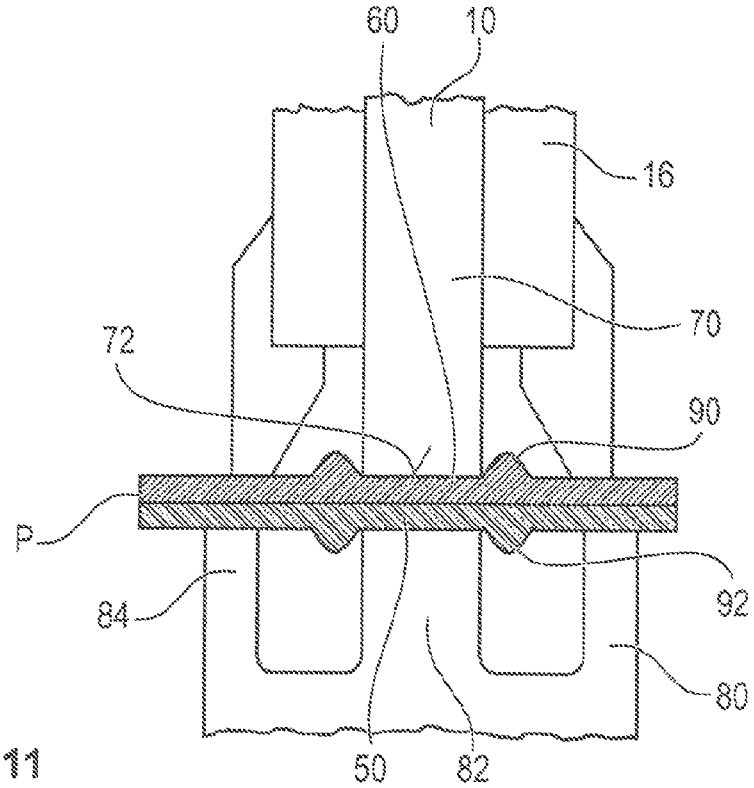
Figure 12:
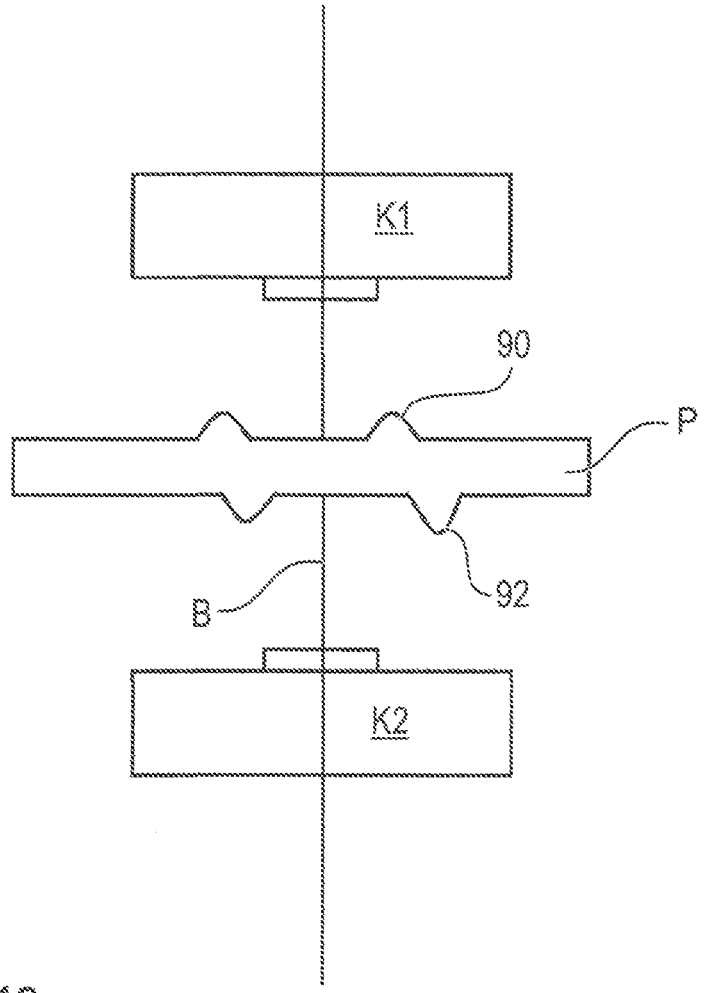

The present disclosure will be explained in greater detail with reference to the accompanying drawings. In the figures:

FIG. 1 shows a schematic representation of a joining process of a rivet with a coaxial alignment between the die and punch, FIG. 2 shows a schematic representation according to FIG. 1 in which the punch and die are not aligned coaxially with each other, FIG. 3 shows a schematic representation of a die with a preferred insertion plate, FIG. 4 shows an embodiment of a die with an embossable grid marking, FIG. 5 shows an embodiment of an embossable grid marking, FIG. 6 shows another embodiment of an embossable grid marking, FIG. 7 shows a schematic plan view opposite the direction of joining of a closing head created in a test part with an embossed grid marking, wherein the punch and die were aligned coaxially during the joining process, FIG. 8 shows a schematic plan view opposite the joining direction of a closing head created in a test part which was created when the punch and die were not coaxially aligned, FIG. 9 shows a schematic representation of a punch and counter-tool that are not coaxially aligned, FIG. 10 shows a schematic representation of the results of reshaping without coaxial alignment (a) and with coaxial alignment (b), FIG. 11 shows an embodiment of an adjustment aid for a joining device, and FIG. 12 shows a schematic representation of a joined test part which is imaged by two cameras arranged opposite each other.

5. DETAILED DESCRIPTION

The present disclosure relates to an adjustment aid for joining devices as initially summarized at the onset. Such joining devices for different application fields comprise a punch 10 and a counter-tool 20. During a joining process, an at least partially flat counter surface 22 of the counter-tool 20 and an at least partially flat punch surface 12 of the punch 10 press against a component, a stack of metal sheets, or other arrangement which is generally designated as the test part P. According to a variant of the present invention, the counter surface 22 and the punch surface 12 acting on the test part P each create a closing ring 90, 92 at the test part P which are arranged on opposite sides of the test part P. In another variant of the present invention, an embossable grid marking 50; 60 is provided on the counter surface 22 and/or the punch surface 12 so that the embossable grid marking 50; 60 is correspondingly embossed in the test part P.

Such joining devices are adjustable regarding the coaxiality of the punch 10 and counter-tool 20, with known constructions. According to an alternative, eccentric bushings are used for such a coaxial adjustment as described in DE 197 43 277 A1.

According to another alternative, a centring sleeve is used to coaxially adjust the punch 10 and counter-tool 20 with reference to each other. The centring sleeve is explained in DE 27 20 126 A1. Since the adjusting options of the punch 10 and counter-tool 20 are generally known, they will not be further addressed in this context. Nevertheless, the disclosure of the two aforementioned documents is incorporated herein by means of reference.

The adjustment aid will subsequently be explained with reference to an example of a setting device for setting a rivet N. The setting device comprises the aforementioned punch 10 with the punch surface 12. The punch 10 is moved in the joining direction F toward a die 20 which constitutes the counter-tool. The die 20 offers the at least partially flat counter surface 22, preferably in the form of its die base 24. Therefore, a pot-shaped die 20 is utilized according to an embodiment, as is for example depicted in FIGS. 1, 2, 3 and 4.

If the preferred pot-shaped die 20 does not have the at least partially flat die base 24, it is achievable with the assistance of an insertion plate 30. For example, FIG. 3 shows the pot-shaped die 20 with a concave die base 24, i.e., a counter surface 22 which is partially not flat. The insertion plate 30 is arranged such that a bottom side 34, shaped to be complementary with the die base 24, of the insertion plate 30 faces the die base 24. A reliable grip arises between the insertion plate 30 and die 20 due to this complementary shape of the insertion plate 30 and die 20. The side 32 of the insertion plate 30 facing the punch 10 is also designed flat in order to form the counter surface 22 opposite the punch surface 12.

The punch 10 sets the rivet N into the test part P via its punch surface 12. During the joining movement of the punch 10 in the joining direction F, the rivet N and the test part P are reshaped in the pot-shaped die 20, or are respectively moulded therein, and a closing head 40 is formed.

According to the representation in FIG. 1, the punch 10 and the die 20 are aligned coaxially with each other as emphasized by the common axis of symmetry S in the joining direction F. Due to the coaxial alignment of the punch 10 and the die 20, the rivet N is evenly deformed and preferably forms a closing head 40 symmetrical with the axis of symmetry S. This closing head 40 preferably completely fills the pot-shaped die 20.

As can be seen in FIG. 2, the punch 10 and the die 20 are not aligned coaxially with each other. During the joining movement of the punch 10 in the joining direction F, the rivet N is not evenly deformed as is discernible with reference to FIGS. 2*d* and 2*e*. The closing head 40 is also formed asymmetrically and does not completely fill the die 20 as is emphasized by the schematic representation in FIG. 2*d*.

The deformation of the rivet N and the formation of the setting head 40 according to FIG. 2*d*, 2*e* produce an unreliable connection with a limited life and/or less strength in comparison to the connection according to FIG. 1*e*. This may be improved by coaxially aligning the punch 10 and the die 20 with each other, and preferably with their axis of symmetry S.

In order to be able to check the coaxial alignment of the punch 10 and die 20 and obtain information on the extent to which the alignment of the punch 10 and/or the die 20 need to be changed, the rivet N is inserted or set into the test part P. During this process, the setting head 40 forms. To evaluate the alignment of the punch 10 and the die 20 relative to each other, a grid marking 52 is embossed in the setting head 40. The at least partially flat counter surface 22, i.e., the die base 24 (see FIG. 3) or the surface 32 of the insertion plate 30, has an embossable grid marking 50.

As for example can be seen in FIGS. 5 and 6, any desired pattern of regular points and/or lines can be utilized as a grid marking which permits the embossed grid marking 52 to be evaluated in comparison with a reference point or reference line.

In at least some embodiments, the embossable grid marking 50 is embossed in the base 42 of the setting head 40. The embossed grid marking 52 therefore can be evaluated with reference to an outer edge 44 of the setting head 40, and/or with reference to a reference hole in the test part P, and/or with reference to an additional grid marking 62 on the side of the test part P facing the punch 10.

According to an embodiment, the embossable grid marking 50; 60 has an orientation marker 54; 64. The orientation marker 54; 64 is aligned with a fixed reference point on the setting device so that the orientation in which the embossed grid marking 52; 62 is to be evaluated with reference to the fixed reference point is always discernible by means of the grid marking 52; 62 embossed in the test part.

It is furthermore preferable to provide the additionally embossable grid marking 60 on the punch surface 12, or a side 72 of a test body 70 (see FIG. 10) facing away from the punch. If the test body 70 is set instead of the rivet N, the side 72 of the test body 70 embosses the other grid marking 62 in the test part P. Accordingly, the grid markings 52; 62 on opposite sides of the test part P can be evaluated to determine the coaxial alignment of the punch 10 and die 20.

The embossable grid marking 50; 60 preferably consists of a pattern that leaves a pattern impression in the test part P shaped complementary with the pattern after a process of reshaping the test part P between the punch 10 and counter-tool 20. Consequently, the embossable grid marking 50; 60 is understood to be the pattern elevated with reference to the surrounding surface, or the embedded pattern, as well as the coloured pattern which is transferable like a stamp.

It is preferable for the die base 24 to have an embossable grid marking 50 which consists of a structure embedded, i.e., recessed, in the base (see FIG. 4). In the same manner, the grid marking 50 (not shown) is also provided on the surface 32 of the insertion plate 30. If the setting head 40 is created in the die 20 during the joining process of the punch 10, the grid marking 50 is embossed in the base 42 of the setting head 40. This is illustrated in FIGS. 7 and 8 which show a schematic plan view of the base 42 of the setting head 40 opposite the joining direction.

In FIG. 7, the punch 10 and the die 20 are aligned coaxially with each other. In FIG. 8, the punch 10 and the die 20 are not aligned coaxially with each other. The embossed orientation marker is identifiable by reference sign 56 in FIG. 7.

If the position of the embossed grid marking 52 is evaluated with reference to the edge area 46 and edge 44 of the setting head 40, it can be seen how much the punch 10 and the die 20 are coaxially aligned with each other. The edge area 46 which is identifiable as a ring surrounds the embossed grid marking 52. The ring 46 designates the transition area between the flat base 42 of the setting head 40 and its edge 44 extending toward the punch 10. Preferably, the edge 44 of the closing head 40 is identifiable with reference to the radially outermost dark line in FIGS. 7 and 8. The concentrically arranged rings of the grid marking 52 are evenly spaced radially from the ring 46 in the circumferential direction. Furthermore, the edge area 46 has an approximately constant width in the circumferential direction. This indicates that the punch has deformed the test part in the middle of the die with the grid markings so that the closing head was able to be formed in a radially symmetrical manner. This affirms the coaxial alignment of the punch 10 and die 20 with each other.

Preferably, a plurality of closing heads 40, such as 4-20 or more preferably 6-10, is generated and correspondingly evaluated to be able to make a reliable evaluation of the coaxiality of the punch 10 and die 20.

If the punch 10 and the die 20, or respectively the counter-tool 20, are not coaxially aligned, the coaxial rings of the embossed grid marking 52 are not evenly spaced from the edge area 46 of the setting head 40. Moreover, the grid marking 52 is preferably not arranged in the middle of the base 42 of the closing head 40. FIG. 8 illustrates that the transition area 46 between the base 42 and edge 44 of the closing head 40 is unevenly formed in the circumferential direction and preferably has a changing radial width.

Since the setting head 40 according to FIG. 2*d*) is unevenly formed when the punch 10 and die 20 are not coaxially aligned, the grid marking 50 of the die base 24 or insertion plate 30 is only embossed off-centre in the setting head 40 and is identifiable there. Consequently, the concentric rings of the embossed grid marking 52 are unevenly spaced from the ring 46, i.e., the transition area to the edge 44 of the setting head 40. In addition, the embossed grid marking 52 is incompletely impressed in the base 42 of the setting head 40 because the die 20 was not completely filled with the material of the test part P. Consequently, the ring 46 along the circumferential direction of the setting head 40 has a changing radial width. In contrast, the radial width of the transition area or ring 46 remain constant when the punch 10 and die 20 are coaxially aligned.

FIG. 8 is a plan view of the setting head 40 opposite the joining direction F. With reference to the closing head 40, the worker sees that the die punch 10 must be repositioned at least toward the arrows R and U in order to achieve a coaxial arrangement of the punch 10 and die 20. Once another setting head 40 has been created after this repositioning, the alignment of the punch 10 and die 20 can be re-evaluated with reference to the position of the embossed grid marking 52 and surrounding ring 46. This procedure is repeated until there is an optimum axial alignment between the punch 10 and die 20.

It is also preferable to create the setting head 40 with the assistance of a test body 70 which forms the punch surface 72. According to an embodiment of the present invention, the surface 72 of the test body 70 has the second embossable grid marking 60. After the conclusion of the joining process, the setting head 40 has an embossed grid marking 52, 62 on each of its sides arranged opposite each other. Both grid markings 52, 62 are evaluated by the worker, for example with reference to the edge of the test part P, with reference to the reference point formed by the setting head 40, by means of any other reference point, or based on the worker's sense of proportion. The second grid marker 62 for the setting head 40 with the grid marking 52 is a helpful addition for more precisely evaluating the alignment between the punch 10 and die 20.

According to another embodiment, after the conclusion of the joining process, the sides of the test part P which are opposite each other are imaged with two cameras K1, K2, the imaging axes B of which are aligned coaxially with each other. The coaxial alignment of the imaging axes B of the two cameras K1, K2 ensures that the detected image data are reproducible in their actual arrangement relative to each other.

The imaged sides of the test part P are detectable by analogue and digital cameras. The image data are then correspondingly evaluated with an analogue or digital image processing technique. For example, it is accordingly preferable to arrange the digitally recorded image data on top of each other corresponding to the imaging axes arranged coaxially with each other. If the grid marking 52 on the closing head 40 and grid marking 62 created by the side 72 of the test body 70 overlap, then the punch 10 and die 20 are aligned coaxially with each other. The same holds true for the overlapping or a coaxial arrangement of two closing rings which can be generated by a die and the punch 10 with or without a test body 70 as explained below.

If the superimposed image data manifest deviations between the grid markings 52, 62 on the top and bottom side of the test part P, the worker must change the alignment of the punch 10 and/or the die 20 so that the grid markings 52, 62 to be subsequently generated are brought into an overlapping arrangement.

According to another embodiment, the punch 10 is used in combination with a die 80 which has a free-standing projection 82 projecting toward the punch 10. The projection 82 is surrounded by a clearance or a free volume which allows unrestricted deformation of the test part P.

The punch 10 is preferably also arranged in a free-standing manner, i.e., surrounded by a clearance or a free volume.

If the test part P is compressed, or respectively deformed or reshaped in the joint direction F between the punch 10 and the projection 82, a punch-side closing ring 90 and a die-side closing ring 92 are formed (see FIG. 9-11). If the axes of symmetry S of the punch 10 and the projection 82 are aligned coaxially with each other, then the closing rings 90, 92 are arranged above each other (see FIG. 10*b*). Given a non-coaxial arrangement of the axes of symmetry S of the punch 10 and the projection 82, the closing rings 90, 92 are arranged laterally offset from each other as shown in FIGS. 9 and 10*a*.

The closing rings embossed in the test part can be evaluated with the evaluation options described above. Accordingly, cameras K1, K2 are preferably used which are arranged opposite each other, the imaging axes B of which are arranged coaxially with each other. These image the two sides of the test part P in order to be able to then evaluate the overlapping detected images.

To facilitate the evaluation with respect to the coaxial arrangement of the punch 10 and die 80, it is furthermore preferable to choose an equally-sized outer diameter of the punch 10 and outer diameter of the projection 82.

To support the evaluation of the created closing rings 90, 92 in the test part P, it is furthermore preferable to emboss the created marking 50; 60 on one or both sides of the test part P. For this purpose, the punch surface 12 and/or the projection 82 facing the punch 10 has the embossable grid marking 50, 60. Instead of the punch 10, it is also conceivable to use the test body 70 which has the grid marking 60 on its side 72 facing the test part P.

To ensure the clearance around the punch 10 and/or the projection 82, a retainer 16 is preferably used in combination with a ring adapter 18 (see FIG. 11). The ring adapter 18 presses the test part P at a radial distance from the punch 10 in order to fix the test part P and at the same time provide the necessary clearance from the punch 10. The projection 82 is preferably surrounded by a ring-like structure 84 which contacts the test part P opposite the ring adapter 18. During a joining process, the closing rings 90, 92 can form unhindered on both sides, whereas the test part P is fixed between the ring adapter 18 and the ring-like structure 84.

The invention claimed is:

1. An adjustment aid for a joining device having a punch and a counter-tool which can be oriented coaxially to one another and are moved axially towards each other during a joining movement, wherein the counter-tool comprises an at least partially flat counter surface which is arranged opposite an at least partially flat punch surface of the punch, and a grid marking which is provided on the counter surface, such that the grid marking is utilized to emboss a test part which is shaped by the counter-surface and the punch surface;

wherein the counter-tool is a pot-shaped die in which an insertion plate is located, the insertion plate providing the counter surface of the counter-tool.

2. The adjustment aid according to claim 1, wherein the insertion plate is formed complementary with a base of the pot-shaped die on a side of the insertion plate facing away from the punch.

3. The adjustment aid according to claim 1, which a closing head is produced by the punch in combination with either a punch rivet or a test body.

4. An adjustment aid for a joining device having a punch and a counter-tool which can be oriented coaxially to one another and are moved axially towards each other during a joining movement, wherein the counter-tool comprises an at least partially flat counter surface which is arranged opposite an at least partially flat punch surface of the punch, and a grid marking which is provided on the counter surface, such that the grid marking is utilized to emboss a test part which is shaped by the counter-surface and the punch surface wherein the counter-tool is a pot-shaped die which provides a base, and the base provides a counter surface of the counter-tool.

5. An adjustment aid for a joining device having a punch and a counter-tool which can be oriented coaxially to one another and are moved axially towards each other during a joining movement, wherein the counter-tool comprises an at least partially flat counter surface which is arranged opposite an at least partially flat punch surface of the punch, and a grid marking which is provided on the counter surface such that the grid marking is utilized to emboss a test part which is shaped by the counter-surface and the punch surface wherein the counter-tool is a test die which has a free-standing projection which projects toward the punch and provides the counter surface with the grid marking wherein the counter-tool is formed such that it includes a clearance surrounding the projection.

6. The adjustment aid according to claim 5 wherein the counter surface with the grid marking forms a side of the projection facing the punch, and the projection has the same outer diameter as the punch surface of the punch or the same diameter as a test body.

7. The adjustment aid according to claim 6, wherein the joining device comprises a hold-down device by which the test part is compressed when a radial clearance is left around the punch or the test body.

8. The adjustment aid according to claim 7, wherein the test die is ring shaped and radially surrounds the projection at a distance and is arranged opposite the hold-down device.

9. The adjustment aid according to claim 5 wherein the joining device comprises a hold-down device by which the test part is compressed when a radial clearance is provided around the punch or a test body.

10. The adjustment aid according to claim 9, wherein the test die is ring-shaped and radially surrounds the projection at a distance and is arranged opposite the hold-down device.

11. The adjustment aid according to claim 5, wherein the punch surface of the punch or a test body which forms the punch surface provides a second grid marking such that the grid marking on the punch surface or the test body and the grid marking on the counter surface emboss the test part during the joining movement.

12. The adjustment aid according to claim 11, wherein the test part has a through-hole which can be arranged between the punch and counter surface as an orientation aid.

13. An adjustment aid for a joining device having a punch and a counter-tool which can be oriented coaxially to one another and can be moved axially towards each other during a joining movement, wherein the counter-tool comprises an at least partially flat counter surface which is arranged opposite an at least partially flat punch surface of the punch, and a grid marking that is utilized to emboss a test part which is shaped by the counter-surface and the punch surface, wherein the counter-tool includes a die with a free-standing projection projecting toward the punch and the counter-tool is formed such that it includes a clearance surrounding the projection, wherein when the punch and the counter-tool are moved axially toward each other two closing rings are formed on a workpiece acted upon by the punch and the counter-tool, and wherein the counter surface and/or the punch surface provide the grid marking by which a misalignment between the punch and counter-tool can be determined.

14. A method for adjusting a joining device having a punch and a counter-tool which can be oriented coaxially to one another and are moved axially towards each other during a joining movement, wherein the method comprises:

performing the joining movement of the punch relative to the counter-tool such that an at least partially flat counter surface of the counter tool or an at least partially flat punch surface of the punch, emboss a grid marking on a test part, evaluating the grid marking on the test part, and changing the orientation of the punch and counter-tool relative to each other to coaxially align the punch and counter-tool.

15. The method according to claim 14 wherein the counter tool is a die including the counter surface and the grid marking is formed by the counter surface, and wherein the method further includes:

creating a closing head within the die and embossing the grid marking in the closing head, and evaluating the embossed grid marking in comparison to an edge area of the closing head.

16. The method according to claim 14 wherein the counter-tool is a die with a free-standing projection which projects toward the punch and the projection provides the counter surface opposite the punch surface of the punch, wherein the joining movement is performed with the punch surface against the counter surface such that one closing ring is formed on each of the opposite sides of the test part, and the closing rings are evaluable.

17. The method according to claim 16, further including:

imaging the test part with at least one camera in order to perform the evaluating step.

18. The method according to claim 17 wherein the imaging step includes imaging two opposite sides of the test part with two cameras, the imaging axes of which are coaxially aligned with each other, and the evaluating step includes evaluating the two imaged sides of the test part.

19. The method according to claim 14 wherein the grid marking is formed by one or both of the counter surface and the punch surface and wherein the method further includes:

embossing the grid marking in at least one side of the test part.

20. The method according to claim 14, further including:

imaging the test part with at least one camera in order to perform the evaluating step.

21. The method according to claim 20 wherein the imaging step includes imaging two opposite sides of the test part with two cameras, the imaging axes of which are coaxially aligned with each other, and the evaluating step includes evaluating the two imaged sides of the test part.

* * * * *